United States Patent [19]

Paisley

[11] 4,038,790

[45] Aug. 2, 1977

[54] PARTITION STRUCTURE

[76] Inventor: John C. Paisley, Rte. 1, Box 4A, Orange, Va. 22960

[21] Appl. No.: 723,894

[22] Filed: Sept. 16, 1976

[51] Int. Cl.[2] ..... E04B 2/78

[52] U.S. Cl. ..... 52/36; 52/495; 52/281; 248/243

[58] Field of Search ..... 52/36, 281, 282, 481, 52/495, 582, 584, 220, 221, 238, 239, 720, 496; 248/243, 293; 211/148, 134

[56] References Cited

U.S. PATENT DOCUMENTS

| | | | |
|---|---|---|---|
| 3,166,285 | 1/1965 | Downes | 248/245 |
| 3,733,755 | 5/1973 | Butler | 52/36 |
| 3,733,756 | 5/1973 | Butler | 52/36 |
| 3,908,320 | 9/1975 | Hogue | 52/36 |
| 3,921,347 | 11/1975 | Paisley | 52/36 |

*Primary Examiner*—J. Karl Bell
*Attorney, Agent, or Firm*—Lee C. Robinson, Jr.

[57] ABSTRACT

The partition structure includes a support post having a plurality of vertical sides and a partition panel secured to one of these sides, with the panel having a bent flange portion located in parallel closely spaced alignment with one of the sides of the post to define a thin cavity therebetween. The side of the cavity adjacent the flange of the panel has a plurality of vertically spaced embossments of predetermined configuration formed thereon extending outwardly of that side towards the flange portion of the adjacent panel. A support bracket having an inner edge portion including a plurality of spaced mounting tabs formed thereon, with the mounting tabs being spaced from each other at regular intervals selected to enter the cavity between said embossments, has edge configurations formed on the tabs to mate with at least a portion of the predetermined configuration of the embossments, thereby to support the bracket on the post.

18 Claims, 6 Drawing Figures

PARTITION STRUCTURE

The present invention relates to partition constructions, and more particularly, to a partition structure for supporting a cabinet, shelf or the wall element.

Movable interior partition structures dividing building spaces in offices, schools and the like have been used and accepted in the construction industry in order to permit flexible designs for building spaces. Such structures are usually manufactured from sheet metal and are relatively simple to erect and disassemble. Such structures usually are spray coated or painted with the desired color in an at least partially assembled position. The preferred type of partition structure provides a flush construction having a uniform and pleasing appearance with no overlapping or protruding parts that would tend to reduce the amount of usable floor space.

Numerous systems for partition constructions have previously been proposed, but in most such systems it is often difficult to conveniently mount hanging cabinets, shelves, or the like on the partition panel so that they fit properly across the panels and particularly into the inside corners between angularly related wall panels without defacing the panels themselves.

The typical partition structure includes vertical support posts and panels secured to the posts. Where provision is made for mounting cabinets or shelves on the posts, or the post supports between the panels, the posts are provided with a structural arrangement which allows shelf brackets to be mounted thereon. One disadvantage of the prior arrangements for this purpose is that it often is difficult for a series of shelves or cabinets to be mounted on adjacent panels at the same elevation since each support post permits the mounting of only one bracket. Accordingly while a single shelf or cabinet could be mounted on one wall panel, no provision is made for a second bracket to permit mounting an additional adjacent shelf at the same level. Accordingly a substantial amount of space suitable for use in providing shelf or cabinet space is wasted. Moreover, with such previously proposed systems, the posts themselves were usually constructed so that the mounting arrangement for the brackets was located within the post, thus eliminating the post as a conduit for electrical connections and wires.

A very suitable solution for the problems of previously proposed partition structures which overcomes the above noted disadvantages is disclosed in U.S. Pat. No. 3,921,347. In that patent a support strip bracket is located in the cavity between at least one side of a hollow vertical support post and a bent flange on the wall panel. This strip has a configuration adapted to receive complementary tabs formed on a shelf bracket or the like. With this arrangement adjacent shelves can be mounted on adjacent wall panels and the post itself is left free to serve as an electrical conduit or chase. However, by the construction of that prior patent, an additional strip of metal is required in order to form the mounting support on the post and, during spray painting operations, the front edge of the brackets get painted but contrast with the inner edges of the recesses on the strip which are not reached in the spray painting operation, so that in the completed product it often appears that portions of the internal supporting strip are unpainted, with the result that when the completed panel is viewed straight on, a series of unpainted areas appear in the cavity between the post and panel. This may or may not be considered aesthetically satisfactory by particular purchasers.

Accordingly, it is an object of the present invention to provide a partition structure which is relatively simple in construction and easy to manufacture while permitting conventient mounting of cabinet and shelf brackets thereon.

Another object of the present invention is to provide a partition structure which permits mounting of cabinet and shelf brackets with a neat appearance on a flush partition wall.

A further object of the present invention is to provide a movable partition structure which is adapted to support shelves and cabinets and yet at the same time provide passageways for electrical wiring.

A further object of the present invention is to provide a partition structure or assembly of the character described which eliminates the need for additional mounting strips for the support brackets.

Yet another object of the present invention is to provide a partition structure which is relatively simple and inexpensive to manufacture.

In accordance with an aspect of the present invention a partition structure adapted to form a flush movable wall includes a generally vertical support post having a plurality of sides and at least one partition panel secured thereto. This panel has a bent flange portion which is located in parallel spaced alignment with one side of the post to define a cavity therebetween. The adjacent side of the post has a plurality of vertically spaced embossments of predetermined configuration formed thereon extending outwardly of the side of the post towards the flange portion of the panel. These embossments each have a top flat horizontal surface portion and a rear flat vertical surface portion extending downwardly from the top surface and defining an inverted L-shaped bearing surface for engaging L-shaped tabs on a bracket inserted into the cavity.

A support bracket having a plurality of L-shaped tabs extending therefrom for insertion in said cavity and support on said embossments is also provided. The tabs of the bracket each include a first leg extending generally perpendicularly therefrom and a second leg spaced from the bracket and extending perpendicularly from the first leg. The embossments are vertically spaced from each other to define slots therebetween having a height which is substantially equal to the sum of the thickness of the first tab and the height of the second tab leg whereby the tabs are readily inserted in the cavity between the post and panel flange through these slots for rigidly supporting the bracket on the embossments.

With this arrangement the bracket is supported along one side of the post while the adjacent side of the post is exposed to permit access to the interior of the post and electrical wires which may be contained therein. Moreover, the mounting for the brackets is provided without the aid of any additional support strip, and with only the structural elements which would be required even if a bracket were not to be mounted on the post. Further, a plurality, or even all, of the vertical sides of the post may be formed with embossments thereon, so that shelves or cabinets can be mounted on adjacent wall panels at the same level in a straight line, or even at right angles to each other.

The above, and other objects, features and advantages of this invention will be apparent in the following detailed description of an illustrative embodiment thereof, which is to be read in connection with the accompanying drawings, wherein.

Figure 1:
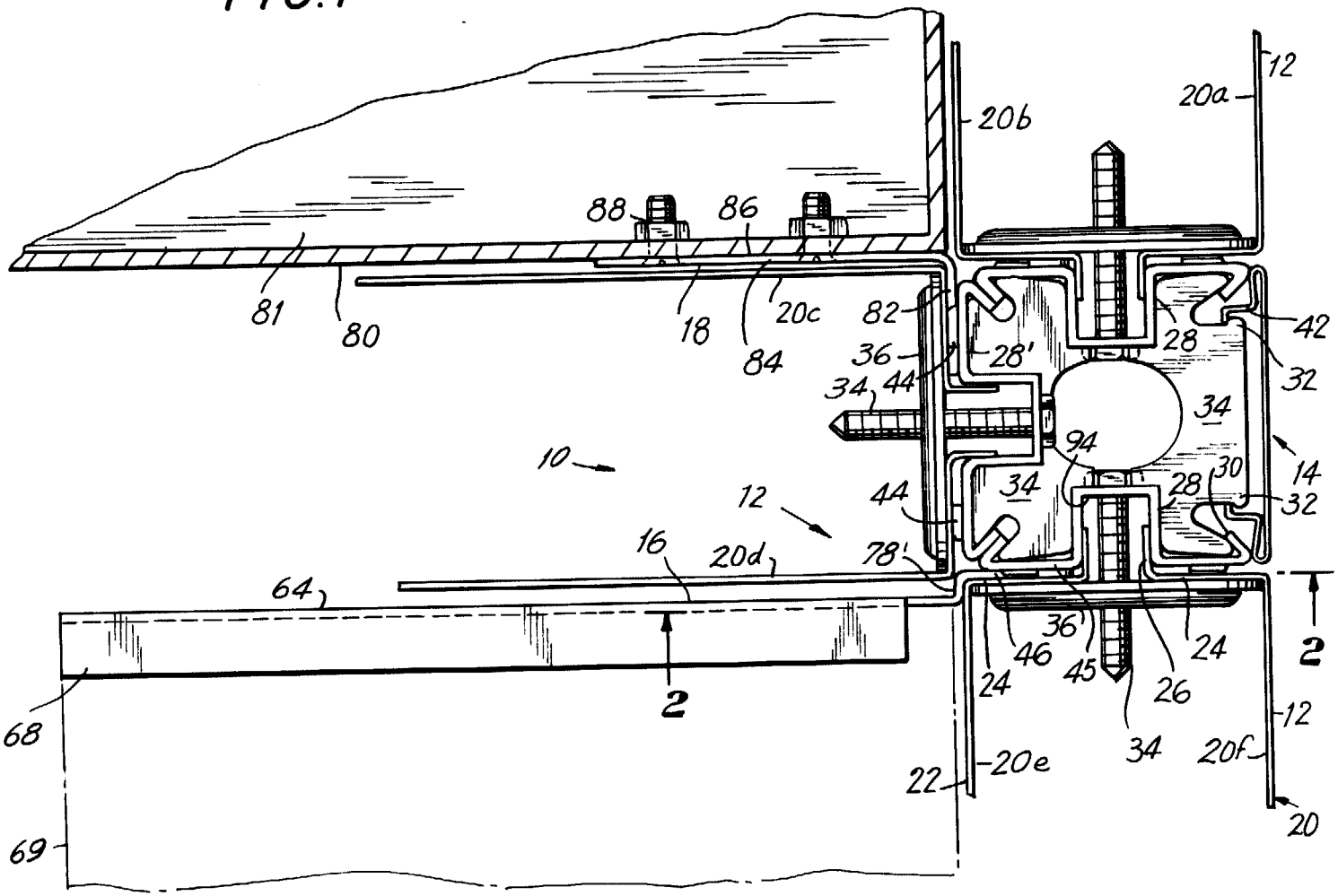
FIG. 1 is an enlarged sectional view, in plan, of a post and panel arrangement for a partition structure constructed in accordance with the present invention.

Referring now to the drawings in detail, and initially to FIG. 1 thereof, a movable partition assembly 10, constructed in accordance with the present invention, is shown as being formed from a series of wall panels 12 connected between a vertically extending support post 14. The panels and posts are readily assembled and disassembled, as described hereinafter, in order to permit the partition arrangement to be varied as desired, and when necessary. The support posts 14 are provided with support bracket structures, also described hereinafter in detail, which provide mounting support for brackets 16 of the type which will support shelves across a wall panel, or cabinet brackets 18, for securing a cabinet to the wall.

Each panel 12 is formed from two panel plates 20, which are of substantially identical constuction. (For convenience, the respective plates shown in FIG. 1 are identified as plates 20*a*–20*f* respectively). Each panel plate is separately formed, and its ends are of identical construction; only one end of each panel being shown in the drawing. More specifically, panel plates 20 each include a vertical face 22 and a bent flange portion 24 extending therefrom, and by which the plates are secured to the posts 14.

Post 14, in the illustrative embodiment, includes three vertical side elements 28 having angularly bent edges 30 which are positioned in abutting relation, as shown in FIG. 1, to provide a right angle joint between the adjacent vertical elements or sides of the post. The fourth side 40 of this square post is formed by a removable cap or post cover having resilient bent ends 42 which permit the cover to be snap fit over tabs 32 formed on key elements 34 provided within the interior of the post 14, in the known manner, to secure the respective vertical elements of the post together and to maintain them in their properly spaced relation. Although the illustrative embodiment of the invention shows post 14 as having three side elements 28 and one cover 40 it is contemplated that the post have only two opposed side elements 28 and two opposed caps 40.

Panel plates 20 are secured to post 14 by screws 34 which are threaded from the interior of the post through the inwardly bent central portions of vertical elements 28 for engagement with clamping members 36, located between the panel plates 20 of each panel 12. As seen in FIG. 1, the bent flange portions 24 of panel plates 20 are positioned between the post and clamping member 36 with the rebent portions 26 of the plates inserted through the central recess of the vertical elements 28. Upon tightening screw 34 the plates are clamped and held in a fixed position with respect to post 14.

The vertical side faces of vertical post elements 28 are each embossed or cold stamped or punched along their vertical length to form a plurality of vertically aligned embossments 44 along their length. (The word embossment as used herein is intended to include stamping and punching operations). These embossments are formed to extend outwardly of post elements 28 into the cavity 46 formed between post element 28 and the bent flange portions 24 of the panel plates. When screw 34 is tightened, the bent flange portion of the plates are clamped against the sides of embossments 44.

Figure 4:
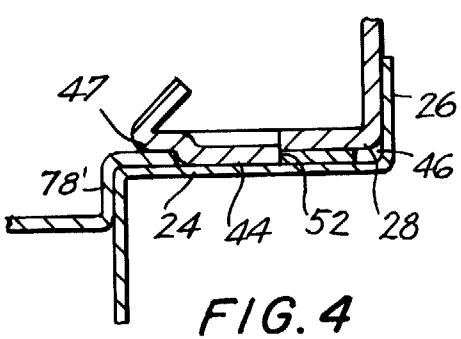
FIG. 4 is a sectional view taken along line 4—4 of FIG. 2.
Figure 3:
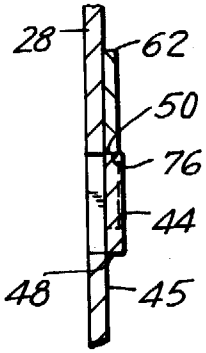
FIG. 3 is a sectional view taken along line 3—3 of FIG. 2.
Figure 5:
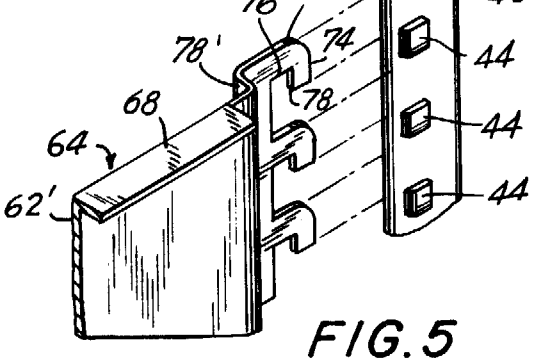
FIG. 5 is a partial exploded perspective view of a shelf bracket and associated side of the vertical support post.

As seen most clearly in FIGS. 3 and 5, embossments 44 are integrally formed with elements 28 along the face 45 thereof and they are formed with a very specific peripheral configuration. In particular, the embossments are cold struck or punched such that their forward edge 47 and their bottom edge 48 are rounded and curved outwardly, remaining integral with post element 28. On the other hand the upper edge 50 and the rear end 52 thereof are formed as relatively flat straight edges which can either remain secured to post element 28 or can be cut therefrom, as seen in FIG. 4. In this manner, embossments 44 provide a generally inverted L-shaped bearing surface which are adapted to receive and engage the generally complementary tabs 62 on the rear edge of a shelf or cabinet support bracket. For example, as seen in FIG. 5, a shelf bracket 64 is illustrated which consists of a flat plate having tabs 62 formed at its rear end, and a horizontally turned flange 68 on which a flat shelf 69 (see FIG. 1) can be supported and secured. The brackets are of lightweight construction and are formed from sheet metal, similar to the sheet metal forming panel plates 20.

In one specific embodiment of the present invention it is preferred that vertical post elements 28 to be formed from 14 gauge steel, with bracket element 64 being formed of 16 gauge steel. Thus, when embossments 44 are struck from the 14 gauge steel post elements 28, the flat faces 50, 52 thereof will extend beyond the side of the post through a dimension which will be equal to or slightly greater than the thickness of 16 gauge steel, but which will be slightly less than the thickness of 14 gauge steel. Accordingly, when panel flanges 24 are clamped tightly against the embossments, cavity 46, formed between the posts and the panel, will have a width which is slightly greater than the thickness of tabs 62.

Embossments 44 are spaced from each other in a vertical direction so as to define slots or openings 70 therebetween which are dimensioned to receive tabs 62 of bracket 64 therethrough. This permits the L-shaped tabs to be inserted directly into cavity 46 through the slots 70 with the brackets in a horizontal position. The vertical leg portion 74 of each of tabs 62 is dimensioned to be slightly smaller than slot 70 so that the tab's leg can be readily received through the slot.

It will be appreciated therefore that upon insertion of tabs 62 into cavity 46 between slots 70, the tabs will move downwardly slightly as the tab leg 74 passes embossments 44. In this manner the bracket is vertically supported on the embossments 44 and held against inadvertent removal by the cooperation between the bearing sufaces 50, 52 of the embossment and the cooperating surfaces 76, 78 on L-shaped tabs 62. Moreover the brackets are supported against lateral movement since the tabs 62 are, in effect, sandwiched between the face of the adjacent vertical post element 28 and the opposed bent flange portion 24 of the adjacent panel plate 20. It is noted that the support arrangement for the bracket 62 in accordance with the present invention is relatively strong since the embossments can be made relatively wide, in a front to back direction, with the surfaces 46, 48 connecting the embossments to the post having relatively large dimensions, so that substantial strength for supporting the brackets is provided.

In order to provide additional bearing support for the brackets, the brackets can be bent, as shown in FIG. 5, so that tabs 62 and the major portion 62' of the bracket 64 extend in parallel longitudinal directions, but in spaced off-set relation to each other. These sections of the bracket are interconnected by a web portion 78', extending perpendicularly thereto and integrally formed therewith. This offset web is adapted to bear against the adjacent panel 20, as seen in FIG. 1, when tabs 62 are mounted on embossments 44. By this arrangement, while substantially all the weight of the brackets and anything mounted thereon is supported on embossments 44, some additional support is provided to the brackets by the engagement between the webs 78' of the brackets and the panels 20.

Another advantageous bracket construction 18 for use with cabinets, is shown in FIG. 1, adjacent panels **20*b*, and 20*c*. Bracket 18, has a generally L-shaped configuration including a short leg 82 having L-shaped tabs 62 formed therein. The long leg of the bracket 18 is secured to the back wall 80 of a cabinet 81 by a plurality of screws 88 or the like. The tabs 62 formed on leg 82 are inserted in the recesses or slots 70 between the embossments 44 formed on the adjacent vertical post element 28'. These embossments are formed on post element 28'** in the same manner as those embossments previously described.

By the construction of the invention illustrated in FIG. 1. it will be appreciated that a shelf or cabinet bracket support can be inserted in any one of the cavities 46 formed between a vertical post element 28 and an adjacent bent flange of a panel 20. Thus, a shelf bracket 64, as seen in FIG. 1, has its inner end inserted within the cavity 46 between the panel plate **20*e* and the adjacent vertical element 28 of the post. The shelf 68 extends along the panel plate 20*e* and a similar bracket 64 on its opposite end is mounted in a corresponding cavity 46 formed between the opposite end of the panel 20*e* and the next post in the partition assembly. In this manner the edge of the shelf 68 can abut the panel plate 20*d* which extends at 90° to the panel plate 20*e* and completely covers the inside corner formed between the two panels 12 at this post 14. This enables the shelf to extend along the entire length of the wall provided by the plate 20*e*** and forms a neat and pleasing appearance for the shelf construction.

Similarly cabinet 81 mounted on post 14, as seen in FIG. 1, has the end of its bracket 18 mounted in the cavity 46 between the bent flange portion of the panel plate **20*c* and its adjacent vertical post element 28'. Again the cabinet encompasses the entire inside corner between the panel plates 20*c* and 20*b*** providing a neat and pleasing appearance for the partition construction.

Figure 2:
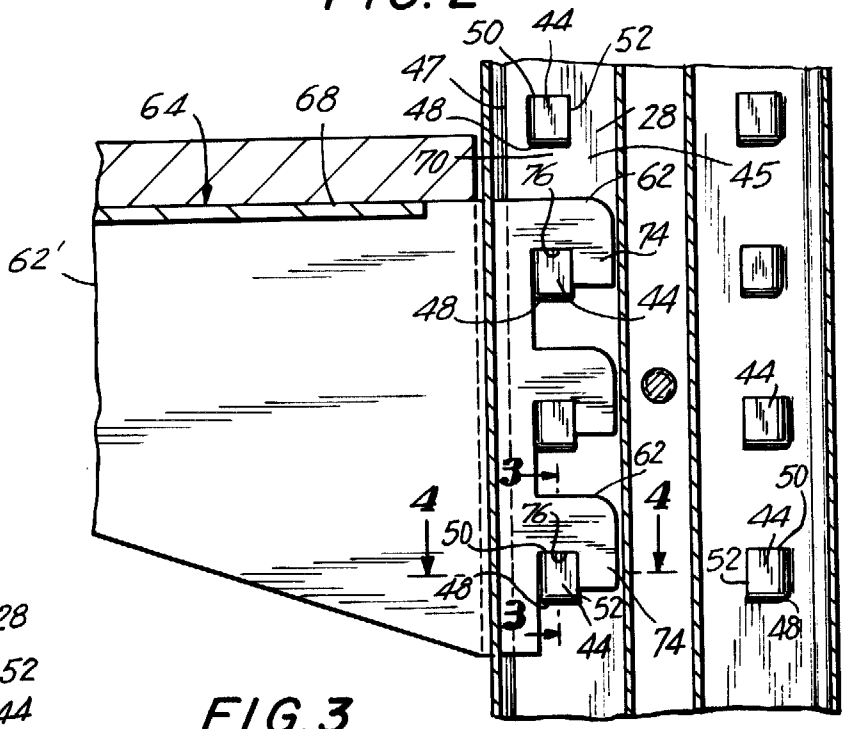
FIG. 2 is a sectional view taken along line 2—2 of FIG. 1.

By providing embossments 44 on the vertical support elements 28, for supporting the brackets of the invention, the interior of the post remains free so as to be available for use as an electrical conduit or mechanical chase, upon removal of the cap 40 which provides access to the interior of the post. At the same time the shelf cabinet or other hanging element can still remain mounted on the post adjacent the cabinet without interfering with the interior of the post. Thus, for example, if shelf bracket 64 of the shelf arrangement shown in FIG. 2 were mounted on the opposite side of the panel **20*e*, i.e. adjacent the panel 20*f*, shelf 68 would not interfere with the removal of cap 40** from the post. That is, the cap could be removed from the post to permit access to electrical cables contained therein, if necessary, without disturbing the shelf or contents.

Moreover, since each post provides two bracket supports on opposite sides, a series of shelves or cabinets can be mounted along the wall formed by the partition assembly with each shelf or cabinet being at the same elevation. For example, if the shelves were to be mounted along the sides **20*a*, 20*f*, of the partition construction illustrated in FIG. 1, the shelves could be mounted along the adjacent panels at the same elevation since one set of embossments 44 is available on each of the opposite sides of post 14**. Accordingly shelves would be supported in the same level on the same post and extend along adjacent panel elements. Such an arrangement would not be possible with many of the prior constructions for partition structures.

Figure 6:
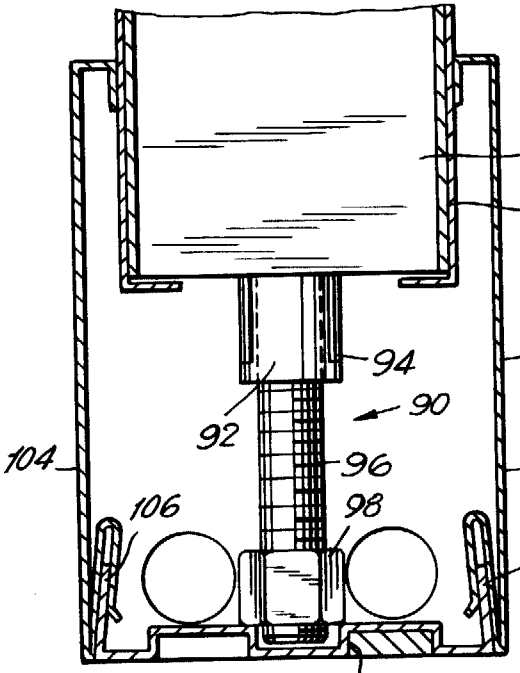
FIG. 6 is a vertical sectional view taken along the bottom of the support post of the present invention.

In addition, according to the invention herein, the bottom end portion post 14 can be provided with an adjustment arrangement 90, as illustrated in FIG. 6. This adjustment arrangement consists of a pair of ferrules 92 (only one of which is seen in FIG. 6) respectively mounted in the lower ends of the channels 94 of an opposed pair of post elements 28. The ferrules are held against rotation in channels 94 and threadably receive a threaded bolt 96. The bottom end of the bolt 96 is threadably engaged with a nut 98 that rests on the base 100 of a bottom strip or molding portion 102 for the partition structure. As seen in FIG. 6, the side walls 104 of the molding structure are formed of bent material which snap fit over flanges 106 on base 100. By adjusting nut 98 the vertical positioning of bolt 96 and of post 14 can be varied. This enables embossments on adjacent posts to be aligned horizontally, in relatively level position with respect to each other so that shelves or cabinets mounted on the posts will be level.

Accordingly, it will be seen that a relatively simply constructed cabinet partition structure is provided which is economical to manufacture, and consists primarily of elements which are already available in the post structure, without the need of any addtional support strips to be secured. Accordingly less metal is required, with the result that the structure is less expensive to manufacture. In addition, because embossments 44 are set back from the front face of the panel structure, when the post and panel assembly is spray painted, any paint which might enter cavity 46 and reach surfaces 47 will not be visible when the completed panel construction is viewed head on. In addition, any paint entering into slots 70 will close any openings formed between surfaces 50, 52 of the embossments and the side face 45 of the post elements, to prevent sound transmission through those openings.

Moreover, by providing embossments integrally formed on the posts 28, these embossments can be more closely spaced than previously proposed constructions requiring separate mounting strips. In a presently preferred embodiment of the invention the embossments can be spaced one inch on center, so that when the posts are erected the embossments on adjacent posts cannot be out of line by more than half an inch. Therefore each post need be adjusted in height only one quarter of an inch, to overcome the maximum misalignment situation.

Thus less adjusting of the post heights is required by the arrangement of the present invention as compared to previously proposed constructions wherein, by the use of separate bracket mounting elements on the posts, the spacing between the mounting segments of the inserts had to be on the order of 1 and one half inches.

Although an illustrative embodiment of the present invention has been described herein with reference to the accompanying drawings, it is to be understood that the invention is not limited to that precise embodiment, and that various changes or modifications can be effected therein by one skilled in the art without departing from the scope or spirit of this invention.

What is claimed is:

1. A partition structure including a support post having a plurality of vertical sides and a partition panel secured to one of said sides, said panel having a bent flange portion located in parallel, closely spaced alignment with one side of the post having a plurality of vertically spaced embossments of predetermined configuration formed thereon extending outwardly of said one side towards said flange portion of the panel to define a cavity therebetween, and a support bracket having an inner edge portion including a plurality of spaced mounting tabs formed thereon, said mounting tabs being spaced from each other at regular intervals selected to enter said cavity between said embossments and having an edge configuration selected to mate with at least a portion of the predetermined configuration of said embossments.

2. A partition structure including a support post having a plurality of vertical sides and a partition panel secured to one of said sides, said panel having a bent flange portion located in parallel, closely spaced alignment with one side of the post having a plurality of vertically spaced embossments of predetermined configuration formed thereon extending outwardly of said one side towards said flange portion of the panel to define a cavity therebetween, and a support bracket having an inner edge portion including a plurality of spaced mounting tabs formed thereon, said mounting tabs being spaced from each other at regular intervals selected to enter said cavity between said embossments and having an edge configuration selected to mate with at least a portion of the predetermined configuration of said embossments; said post and panel defining an open slot therebetween permitting access into said cavity and said embossments each having a first relatively flat surface portion extending perpendicularly to said slot and a second relatively flat surface portion extending generally perpendicularly to the first surface portion, said first and second surface portions defining a generally L-shaped bearing surface andd said edge configuration of said tab having a complementary L-shaped configuration.

3. A partition structure including a support post having a plurality of vertical sides and a partition panel secured to one of said sides, said panel having a bent flange portion located in parallel, closely spaced alignment with one side of the post having a plurality of vertically spaced embossments of predetermined configuration formed thereon extending outwardly of said one side towards said flange portion of the panel to define a cavity therebetween, and a support bracket having an inner edge portion including a plurality of spaced mounting tabs formed thereon, said mounting tabs being spaced from each other at regular intervals selected to enter said cavity between said embossments and having an edge configuration selected to mate with at least a portion of the predetermined configuration of said embossments; said post and panel defining an open slot therebetween permitting access into said cavity and said embossments each having a first relatively flat surface portion extending perpendicularly to said slot and a second relatively flat surface portion extending generally perpendicularly to the first surface portion, said first and second surface portions defining a generally inverted L-shaped bearing surface and said edge configuration of said tab having a complementary inverted L-shaped configuration.

4. A partition structure as defined in claim 1 wherein the width of said embossments is substantially equal to the width of said cavity.

5. A partition structure as defined in claim 4 wherein the width of said tabs is slightly less than the width of said embossments.

6. A partition structure as defined in claim 5 wherein said one side of the post and said bracket are formed of sheet metal.

7. A partition structure as defined in claim 6 wherein said one side of the post is formed of 14 gauge sheet steel and said bracket is formed of 16 gauge steel, said flat surfaces of said embossments being struck from said one side to have a width at least equal to 16 gauge.

8. A partition structure as defined in claim 3 wherein said tabs each include a first leg extending generally perpendicularly from the bracket and a second leg spaced from the bracket and extending perpendicularly to the first leg.

9. The partition structure as defined in claim 8 wherein said post includes a second side extending generally perpendicularly to said one side thereof and lying in substantially the same plane as said panel, said second post side including a removable cap extending along the length of the post whereby the interior of said post can be exposed by removal of said cap without removal of said bracket from said support strip.

10. A partition structure including a support post having a plurality of vertical sides and a partition panel secured to one of said sides, said panel having a bent flange portion located in parallel, closely spaced alignment with one side of the post having a plurality of vertically spaced embossments of predetermined configuration formed thereon extending outwardly of said one side towards said flange portion of the panel to define a cavity therebetween, and a support bracket having an inner edge portion including a plurality of spaced mounting tabs formed thereon, said mounting tabs being spaced from each other at regular intervals selected to enter said cavity between said embossments and having an edge configuration selected to mate with at least a portion of the predetermined configuration of said embossments; said bracket having a first leg extending generally parallel to and offset from said tabs and includes a web portion extending generally perpendicularly to and connecting said leg and tabs, said web portion bearing against one of said panel and post when said tabs are engaged with said embossments in said cavity.

11. A partition structure including a vertical support post having a plurality of sides and a first partition panel secured thereto, said first panel having a bent flange portion which is located in parallel spaced alignment with one side of said post to define a cavity therebetween, said one side of said post having a plurality of vertically spaced embossments of predetermined configuration formed thereon extending outwardly of said one side towards said flange portion of the panel, said embossments each having a top flat horizontal surface portion and a rear flat vertical surface portion extending downwardly from said top surface and defining an inverted L-shaped bearing surface, for engaging the L-shaped tabs of a bracket inserted into said cavity; a support bracket having a plurality of L-shaped tabs extending therefrom for insertion in said cavity and support on said embossments, said tabs each including a first leg extending generally perpendicularly therefrom and a second leg spaced from the bracket and extending perpendicularly from the first leg; said embossments being spaced vertically from each other to define slots therebetween having a height which is substantially equal to the sum of the thickness of the first tab leg and the height of the second tab leg whereby the tabs are readily inserted in said cavity through said slots for rigidly supporting the bracket on the embossments.

12. A partition structure including a vertical support post having a plurality of sides and a first partition panel secured thereto, said first panel having a bent flange portion which is located in parallel spaced alignment with one side of said post to define a cavity therebetween, said one side of said post having a plurality of vertically spaced embossments of predetermined configuration formed thereon extending outwardly of said one side towards said flange portion of the panel, said embossments each having a top flat horizontal surface portion and a rear flat vertical surface portion extending downwardly from said top surface and defining an inverted L-shaped bearing surface, for engaging the L-shaped tabs of a bracket inserted into said cavity; a support bracket having a plurality of L-shaped tabs extending therefrom for insertion in said cavity and support on said embossments, said tabs each including a first leg extending generally perpendicularly therefrom and a second leg spaced from the bracket and extending perpendicularly from the first leg; said embossments being spaced vertically from each other to define slots therebetween having a height which is substantially equal to the sum of the thickness of the first tab leg and the height of the second tab leg whereby the tabs are readily inserted in said cavity through said slots for rigidly supporting the bracket on the embossments; and a second panel substantially identical to the first panel and secured to another side of the post to extend therefrom at approximately 90° from said first mentioned panel in substantially the same plane as said one side of the post whereby said cavity remains exposed to receive the tab or bracket therein.

13. A partition structure including a support post having a plurality of vertical sides and a partition panel secured to one of said sides, said panel having a bent flange portion located in parallel, closely spaced alignment with one side of said post to define a thin cavity therebetween, said one side of the post having a plurality of vertically spaced embossments of predetermined configuration formed thereon extending outwardly of said one side towards said flange portion of the panel, for receiving the generally complementary shaped tabs of a bracket.

14. A partition structure including a vertical support post having a plurality of sides and a first partition panel secured thereto, said first panel having a bent flange portion which is located in parallel spaced alignment with one side of said post to define a cavity therebetween, said one side of said post having a plurality of vertically spaced embossments of predetermined configuration formed thereon extending outwardly of said one side towards said flange portion of the panel, said embossments each having a top flat horizontal surface portion and a rear flat vertical surface portion extending downwardly from said top surface and defining an inverted L-shaped bearing surface, for engaging the L-shaped tabs of a bracket inserted into said cavity.

15. A partition structure as defined in claim 11 wherein said post includes a second vertical side extending generally perpendicularly to said one side of the post and located adjacent to said cavity leaving said cavity exposed for insertion of a bracket therein, said second side of the post comprising a removable cap mounted on the post whereby the interior of the post can be exposed by removal of said cap without removing the bracket from said cavity.

16. A partition structure including a vertical support post having a plurality of sides and a first partition panel secured thereto, said first panel having a bent flange portion which is located in parallel spaced alignment with one side of said post to define a cavity therebetween, said one side of said post having a plurality of vertically spaced embossments of predetermined configuration formed thereon extending outwardly of said one side towards said flange portion of the panel, said embossments each having a top flat horizontal surface portion and a rear flat verticaly surface portion extending downwardly from said top surface and defining an inverted L-shaped bearing surface, for engaging the L-shaped tabs of a bracket inserted into said cavity; a support bracket having a plurality of L-shaped tabs extending therefrom for insertion in said cavity and support on said embossments, said post being polygonal in cross-section having a pair of adjacent angularly related intersecting sides, each of said intersecting sides having said vertically spaced embossments formed thereon.

17. A partition structure for removably supporting a mounting bracket having a plurality of protruding tabs formed thereon, said partition structure comprising a support post and at least one post panel secured to the post, the panel having an edge portion which is located in parallel spaced alignment with the post to define a cavity therebetween, said post being polygonal in cross-section, the side of said post spaced from said panel flange and an adjacent side of the post intersecting the first mentioned side each having a plurality of vertically spaced embossments of predetermined configuration formed thereon extending outwardly therefrom, whereby the embossments on said sides of the post are adjacent the apex between said post sides and face at angles to each other, for selectively supporting a mounting bracket thereon.

18. A partition structure including a post and a first partition panel secured thereto, said first panel having a bent flange portion which is located in parallel spaced alignment with one side of said post to define a cavity therebetween, said one side of the post having a plurality of vertically space embossments of predetermined configuration formed thereon extending outwardly of said one side and a second panel substantially identical to said first panel and secured to said post to extend therefrom at an angle to said first panel in substantially the same plane as said one side of the post whereby said cavity remains exposed to receive a bracket therein for supporting an article against the second panel.

* * * * *